US007564030B2

(12) United States Patent
Shrader et al.

(10) Patent No.: US 7,564,030 B2
(45) Date of Patent: Jul. 21, 2009

(54) METHOD AND SYSTEM FOR FORMING TEMPORARY IMAGES

(75) Inventors: Eric J. Shrader, Belmont, CA (US); Gabriel Iftime, Mississauga (CA); Peter M. Kazmaier, Mississauga (CA)

(73) Assignees: Palo Alto Research Center Incorporated, Palo Alto, CA (US); Xerox Corporation, Norwalk, CT (US)

( * ) Notice: Subject to any disclaimer, the term of this patent is extended or adjusted under 35 U.S.C. 154(b) by 344 days.

(21) Appl. No.: 11/705,913

(22) Filed: Feb. 13, 2007

(65) Prior Publication Data

US 2008/0191136 A1 Aug. 14, 2008

(51) Int. Cl.
*G03G 5/16* (2006.01)
*B41J 2/32* (2006.01)

(52) U.S. Cl. ..... 250/316.1; 250/551; 250/214 R; 250/504 R; 250/372; 503/201; 347/179; 348/222.1

(58) Field of Classification Search ..... 250/316.1, 250/551, 214 R, 504 R, 372; 503/201; 347/179; 348/222.1

See application file for complete search history.

(56) References Cited

U.S. PATENT DOCUMENTS

| | | | | |
|---|---|---|---|---|
| 2005/0244742 | A1 | 11/2005 | Iftime et al. | |
| 2005/0244743 | A1 | 11/2005 | Iftime et al. | |
| 2005/0244744 | A1 | 11/2005 | Kazmaier et al. | |
| 2008/0151033 | A1 * | 6/2008 | Ishimi et al. | 347/179 |
| 2008/0153698 | A1 * | 6/2008 | Kawahara et al. | 503/201 |
| 2008/0214391 | A1 * | 9/2008 | Kawahara et al. | 503/201 |

* cited by examiner

*Primary Examiner*—Nikita Wells
(74) *Attorney, Agent, or Firm*—Fay Sharpe LLP

(57) ABSTRACT

The presently described embodiments comprise a system that includes a color changing medium, an erasing device using heat or long wavelength infrared light as the erasing source, a writing device that can imagewise apply a UV light to write the image on the media, and a transport to transport the media along a paper path to be seen by the erasing device and the writing device. The system could also function in an alternative way. The image could be "erased" to the all dark state using light (e.g. ultraviolet light) and then heated or illuminated using, for example, infrared light in imagewise fashion to produce the image.

17 Claims, 3 Drawing Sheets

METHOD AND SYSTEM FOR FORMING TEMPORARY IMAGES

BACKGROUND

Many paper documents are promptly discarded after use. Although paper is inexpensive, the quantity of discarded paper documents is enormous and the disposal of these paper documents raises significant cost and environmental concerns.

To address this problem, transient document media systems have been developed. Transient document media is a media designed to replace conventional paper for some applications. It is typically marked upon using ultraviolet (UV) light and typically erased with heat. It is designed so that the media, or paper, may be reused with different images rendered thereon so one can replace paper printing in some applications.

In this regard, transient document media involves providing a reimagable medium comprised of a substrate and a photochromic material, wherein the medium is capable of exhibiting a color contrast and an absence of the color contrast. The reimagable medium is exposed to an imaging light corresponding to a predetermined image to result in an exposed region and a non-exposed region. The color contrast is present between the exposed region and the non-exposed region to allow a temporary image corresponding to the predetermined image to be visible to the naked eye.

In one form, this type of marking on paper can be accomplished by using paper having a particular dye coated thereon. Exposed regions of the dyed paper may then be excited by a radiation source such as ultraviolet light.

To erase the temporary image, transient document media systems subject a temporary image to an indoor ambient condition for a time period. This serves to change the color contrast to erase the temporary image without using an image erasure device. Thus, the temporary image is visible for a time sufficient for the observer to view the temporary image. However, the visible time is limited to permit the optional feature of repeating the procedure as described. So, the temporary image information and temporary image erasure may be performed a number of times on the same media. In some forms, the reimagable medium may be considered self-erasing.

Transient document systems of this type are described in U.S. Publication No. US 2005/0244742 A1, entitled "Reimagable Medium with Light Absorbing Material," filed Apr. 29, 2004, U.S. Publication No. US 2005/0244743 A1, entitled "Reimagable Medium," filed Apr. 29, 2004, and U.S. Publication No. US 2005/0244744 A1, entitled "Method for Forming Temporary Image," filed Apr. 29, 2004, all of which are incorporated herein by this reference.

The present system further addresses the above-described problem of paper documents by providing a method of and an environment for writing an image on a transient document medium and subsequently erasing that medium so that it can be reused instead of disposed.

INCORPORATION BY REFERENCE

U.S. Patent Publication Nos. 2005/0244742 A1, 2005/0244743 A1 and 2005/0244744 A1 are hereby incorporated in their entirety by reference.

BRIEF DESCRIPTION

In one aspect of the presently described embodiments, the system comprises a path having transient media conveyed therethrough, a heating element disposed along the path, the heating element operative to heat the transient media to place the transient media in a first visual state, and, a light source disposed along the path, the light source being operative to place the transient media in a second visual state.

In another aspect of the presently described embodiments, the system further comprises a print controller.

In another aspect of the presently described embodiments, the system further comprises a raster image processor.

In another aspect of the presently described embodiments, the first visual state is an erased state.

In another aspect of the presently described embodiments, the first visual state is an imaged state.

In another aspect of the presently described embodiments, the second state is an erased state.

In another aspect of the presently described embodiments, the second state is an imaged state.

In another aspect of the presently described embodiments, the light source is an ultraviolet light source.

In another aspect of the presently described embodiments, the heating element is a long wavelength heat source.

In another aspect of the presently described embodiments, the light source is programmable.

In another aspect of the presently described embodiments, the heating element is programmable.

In another aspect of the presently described embodiments, the heating element is a fuser of a multifunction device.

In another aspect of the presently described embodiments, the method comprises processing an image to be printed, conveying a transient media sheet on a path, erasing the transient media sheet using a heating element along the path, and, forming the image on the transient media sheet using a light source along the path.

In another aspect of the presently described embodiments, the image comprises using an ultraviolet light source.

In another aspect of the presently described embodiments, the method comprises processing an image to be printed, conveying a transient media sheet on a path, erasing the transient media sheet using a light source along the path, and, forming the image on the transient media sheet using a heating element along the path.

In another aspect of the presently described embodiments, the light source is an ultraviolet light source.

In another aspect of the presently described embodiments, the heating element is programmable.

DETAILED DESCRIPTION

The presently described embodiments comprise a system that includes a color changing medium such as the transient document medium described in U.S. Publication No. 2005/0244744 A1 (which is incorporated herein by reference), an erasing device using, for example, heat or long wavelength infrared light as the erasing source, a writing device that can imagewise apply a light (e.g. ultraviolet light) to write the image on the media, and a transport to transport the media along a paper path to be seen by the erasing device and the writing device. The system could also function in an alternative way. The image could be "erased" to the all dark state using the light (e.g. ultraviolet light) and then heated or illuminated using, for example, infrared light in imagewise fashion to produce the image.

Figure 1:
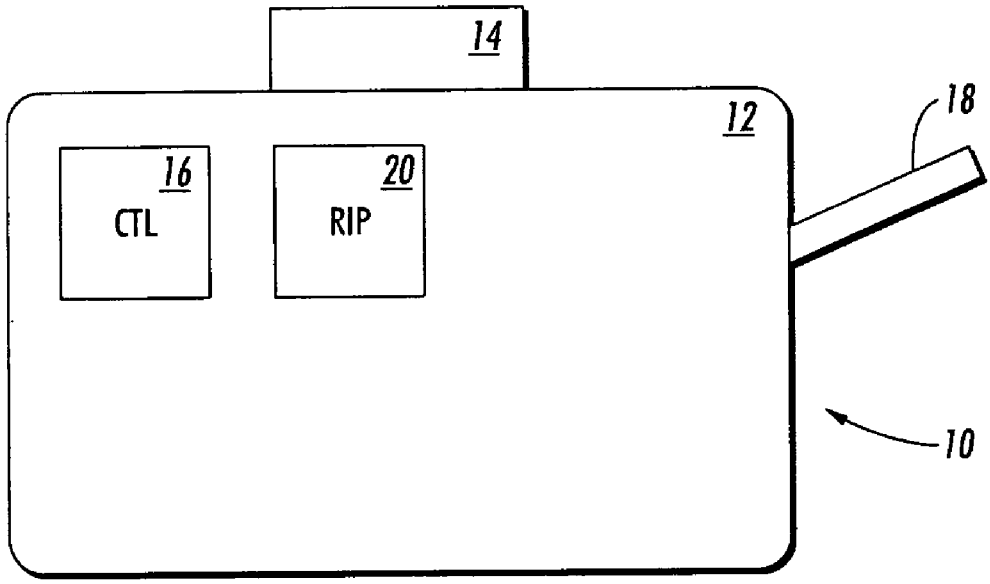
FIG. 1 is an illustration of an image rendering device into which the presently described embodiments are incorporated.

Referring now to FIG. 1, a system 10 into which the presently described embodiments are incorporated is illustrated. As shown, the system 10 includes an image rendering unit 12 having provided thereto a temporary imaging unit 14. Also shown as part of the system 10 are print controller 16 and a raster image processor (RIP) 20. A standard printer controller and raster image processor with some custom electronics to accommodate the objectives of the presently described embodiments may be used. Any such modifications to the print controller or the raster image processor will be apparent upon a reading of the descriptions herein.

The image rendering unit 12 also includes an output tray 18. It should be understood that although the system 10 generally resembles a multifunction rendering device, it may be implemented as any of a variety of types of image rendering devices including printers, copiers or combination (or multifunction) systems.

In this form, the system 10 is a system dedicated to image rendering using transient document media, such as that described in connection with the above-noted patent application. Of course, other types of transient media may be utilized, provided the objectives of the presently described embodiments are obtained. In this regard, any medium that allows for color changing which creates contrast by implementing an excitation source would suffice. That is, the medium used should have a first visual state, and a second visual state that can be initiated upon implementation of the excitation source.

The image rendering unit 12 may take a variety of forms but, in at least one form, it includes components that function to have receive and recognize a page or an image file. In the printer environment, for example, the input may be provided by another network element and received in an input buffer or queue. In the copier environment, the input may be received by an attached scanner or the like and converted to a recognizable image format. In either case, the input file is processed by the raster image processor 20 and printed under the control of the print controller 16. It should be appreciated that the printing in this embodiment is accomplished using transient document media; therefore, the image rendering unit does not incorporate many of the components typically incorporated in a printer, such as toner cartridges, fuser rolls, . . . etc. A suitable path to convey the sheets from the input to the temporary image unit 14, and then to the output, is, however, provided to the image rendering unit 12. In this regard, these elements provide the control and image data path. The data path contains buffer elements that synchronize the image data so that when the printed portion of a job is printed, the data is held due to location of the write bar with respect to the main image path. The functionality of the temporary imaging unit 14 will be described in greater detail in connection with FIG. 3.

Figure 2:
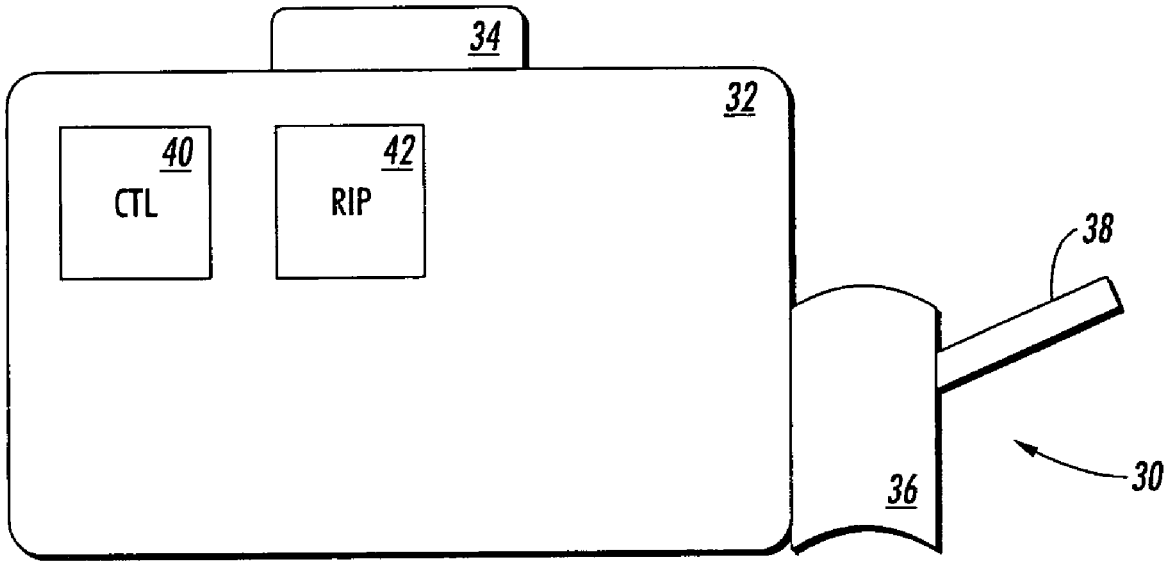
FIG. 2 is an illustration of another image rendering device into which the presently described embodiments are incorporated.

With reference now to FIG. 2, a system 30 illustrates an image rendering device 32 having, as an option, a traditional scanning unit 34 provided thereto. It should be understood that although the device 32 generally resembles a printer/copier multifunctional system, it may be implemented as any of a variety of types of image rendering devices including printers, copiers or combination (or multifunction) systems.

The image rendering unit 32 is also provided with a temporary image unit 36 having the output tray of the system connected thereto. The image rendering unit 32 also includes a printer controller 40 and a raster image processor 42. A standard printer controller and raster image processor with some custom electronics to accommodate the objectives of the presently described embodiments may be used. Any such modifications to the print controller or the raster image processor will be apparent upon a reading of the descriptions herein.

It should be appreciated that the system 30, as opposed to the system 10, is operative to print traditional document media as well as transient document media. In one form, the temporary imaging unit 36 is positioned within the paper path at the output of the system so that selected pages can be printed using transient media to form temporary images. In one example, fax coversheets are printed on transient media using the temporary image unit 36 while the remaining pages of the print job are printed using more traditional methods. The transient media is simply provided in a separate paper supply tray and the print controller 40 controls a selection of pages to be printed using a transient document media. These processes for selectively printing on different sheets of media are known in the art e.g., printing on letterhead, . . . etc.

The image rendering unit 32 may take a variety of forms but, in at least one form, it includes components that function to receive and recognize a page or an image file. In the printer environment, for example, the input may be provided by another network element and received in an input buffer or queue. In the copier environment, the input may be received by an attached scanner or the like and converted to a recognizable image format. In either case, the input file is processed by the raster image processor 42 and printed under the control of the print controller 40. It should be appreciated that the printing in this embodiment is accomplished using both traditional document media and transient document media; therefore, the image rendering unit incorporates many of the components typically incorporated in a printer, such as toner cartridges, fuser rolls, . . . etc. A suitable path to convey the sheets from the input to the temporary image unit 36 or a traditional print engine, and then to the output, is also provided to the image rendering unit 32. These elements provide the control and image data path. The data path contains buffer elements that synchronize the image data so that when the printed portion of a job is printed, the data is held due to location of the write bar with respect to the main image path. The functionality of the temporary imaging unit 36 will be described in greater detail in connection with FIG. 3.

Figure 3:
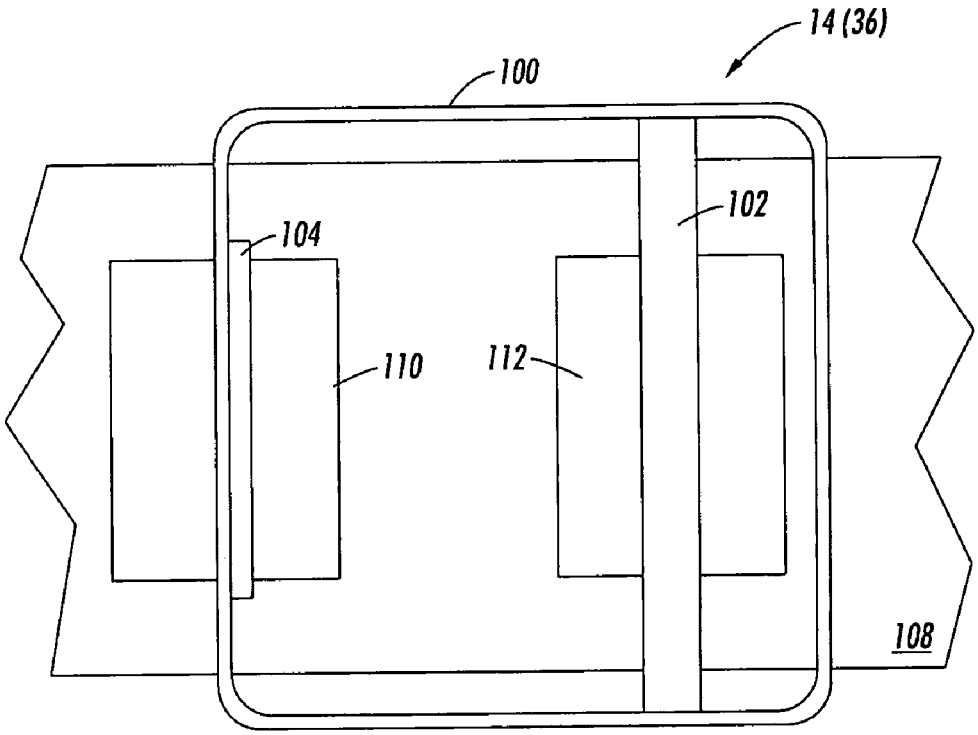
FIG. 3 is a unit to be used in conjunction with an image rendering device according to the presently described embodiments.

Referring now to FIG. 3, a temporary imaging unit 100 is illustrated. This unit may be provided in either the temporary image unit 14 of device 12 or the temporary image unit 36 of device 32. In either case, the unit 100 comprises a light source 102 as well as a heating element 104. Both of these elements are, in one form, disposed along a paper path 108 so that sheets 110 and 112 can be suitably printed.

The device 100 uses a suitable paper feed mechanism and transport systems to feed the sheets through the paper path 108. The components of such a transport system are well known to those of skill in the art. For example, an appropriate configuration of conveyor devices such as transport rollers and mechanical control systems may be used to transport the sheets (e.g. sheets 110 and 112) through the system to be seen, or acted upon, by the light source 102 and/or the heating element 104.

The light source 102 may take a variety of forms. In one form, a light bar, or print head, formed of light emitting diodes (LEDs) that emit in the ultraviolet range is provided. In this environment, pixel by pixel control of the ultraviolet light to form the appropriate image is facilitated by the print controller 16 or 40. Of course, any suitable wavelength of light may be used to implement the presently described embodiments, provided the transient document media responds appropriately to the selected wavelength.

The heating element 104 may also take a variety of forms including that of a long wavelength heating device such as an infrared heating source. In another form, the heating element 104 may take the form of the fuser of the multifunction device to provide the erase function. Of course, this alternative is appropriate for the image rendering unit 32 of FIG. 2, which device includes a fuser. In another form, the heating element 104 is a programmable heating device, such as those traditionally used to implement thermal facsimile machines.

It should be understood that the direction of the sheet transport along the path 108 will vary from implementation to implementation as a factor of the use of the light source and the heating element, as will be described in greater detail in connection with FIGS. 4 and 5, for example. In any case, the path 108, e.g. a paper path, terminates with at the output tray 18 or 38. Of course, it is to be appreciated that the output tray and the input tray functions could be combined so that the users need not move any "used" stack of media.

It should be understood that the overall rendering process according to the presently described embodiments includes the functions of clearing or erasing the sheet, and then forming the temporary image on the sheet. That is, the sheet is placed in first visual state (e.g. an erased state) and, upon selected excitation of the sheet or a part of the sheet by an excitation source (such as heat or light), is placed in second visual state. In one form, the clearing or erasing of the sheet is accomplished using transient document media described above and heated using the heating element 104. The temporary image can then be formed on the erased sheet using the light source 102. In another form, the light source 102 can be used to erase a sheet by forming a completely dark image on the sheet, for example. The heating element 104 is then used to form images on the sheet by erasing portions of the dark image. The heating element 14, in at least this form, is a programmable heating element. Such heating elements are known in the art in, for example, thermal fax machine technology.

Figure 4:
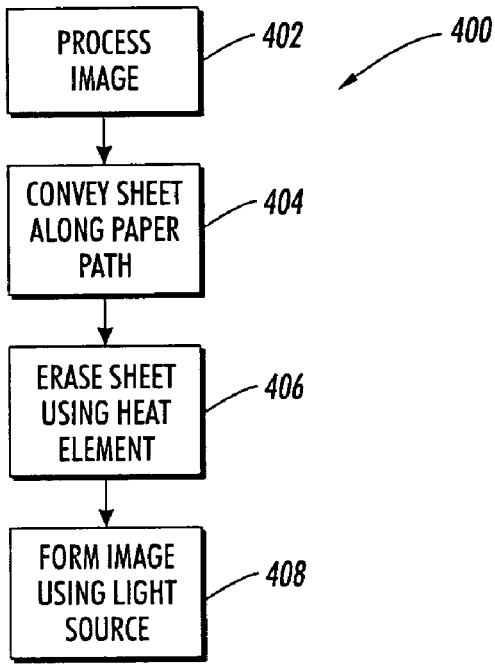
FIG. 4 is a flow chart illustrating a method according to the presently described embodiments; and, FIG. 5 is a flow chart illustrating another method according to the presently described embodiments.
Figure 5:
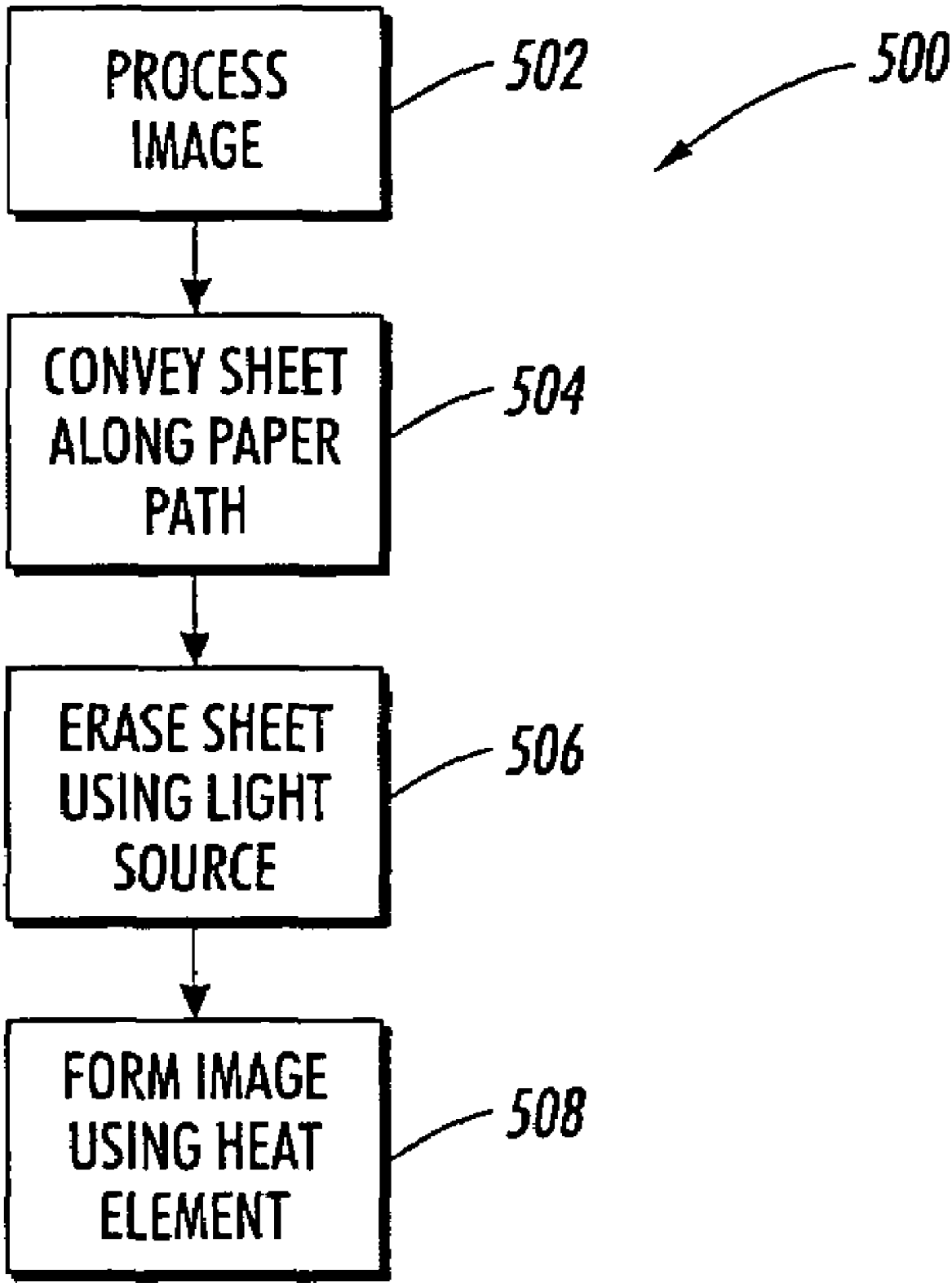

In this regard, FIGS. 4 and 5 illustrate methods according to the presently described embodiments. It should be understood that methods may be implemented in the system using a variety of hardware configurations and/or software techniques. For example, the routines that implement the method on the printers/copiers according to the presently described embodiments, may reside within the print controller of either the device 12 or the device 32. Of course, other printing elements, such as the raster image processor, may house various parts of routines that may be used in implementing the presently described embodiments. In this way, the software implementing the system may be centralized or distributed in the system. Further, the routines may be implemented in a downstream or upstream process in the rendering environments contemplated.

With reference now to FIG. 4, a method 400 is illustrated. The method 400 includes, initially, a function of processing the image using conventional techniques in the raster image processor (at 402). It should be appreciated that this function may be accomplished whether the device is a printer, copier, or a combination device. Also, the transient document media is conveyed along the paper path (at 404). It should be understood that this function may be accomplished in a variety of manners that are well known in the art, such as through the use of rollers and nips. Next, the transient document media is erased using a heating element, such as heating element 104 (at 406). Last, the light source 102 is then used to write or form images on the transient media (at 408). It should be understood that, in one form, the light source is an ultraviolet light source. However, other types of light sources that would cause an excitation of the transient document medium could be used. Control of the light source 102 is accomplished through the print controller. This control of a light bar on a pixel by pixel basis for printing or scanning purpose is well known in the art.

Referring now to FIG. 5, another method according to the presently described embodiments is illustrated. As shown, the method 500 includes the function of processing the image (at 502). Again, it should be understood that processing the image may be accomplished in either a printer, copier, or other device combining both functions and is accomplished in conventional manners. Also, the transient document medium is conveyed along the paper path in the system (at 504). This conveyance may be accomplished in a variety of well known manners. The transient medium is then erased using the light source (at 506). It should be understood that the light source may take a variety of forms, including ultraviolet forms. In any event, the light source activates the transient medium such that the medium is completely imaged or, in one form, rendered dark. The transient media is then conveyed to the heating element which forms the temporary images on the transient media (at 508). Of course, in this instance, the heating element is actually heating the dark imaged portions of the sheet to create the image, i.e., erasing dark portions on the sheet. In at least one form, the heating element is programmable so that pixel by pixel control of the printing process through the heating element is attained.

Since the media must be re-imaged many times and pass through the printer document handling system, the polymer content of the coated paper and the dye pigment content of the coating mixture may be modified to provide the best compromise between sensitivity, multiple paper re-feeds, paper robustness, and image lifetime for use with the document handling and image system.

This system allows the reusable color changing media to replace conventional printing for some portion of the print jobs. Since the media is reusable from 50 to 100 times, significant savings both in terms of cost and environmental impact can be realized. It may also enable business processes that depend on the erasable and reusable properties of the media to significantly improve productivity and reduce costs.

There are several other variations that would work to provide the same function. The media could also be written using a laser based rotating or vibrating mirror scanner instead of the light bar. It could also be written using a mask with a pattern.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A system for forming temporary images on a transient medium, the system comprising:

a path having transient media conveyed therethrough;

a heating element disposed along the path, the heating element operative to heat the transient media to place the transient media in a first visual state; and, a light source disposed along the paper path, the light source being operative to place the transient media in a second visual state.

2. The system as set forth in claim 1, further comprising a print controller.

3. The system as set forth in claim 1, further comprising a raster image processor.

4. The system as set forth in claim 1 wherein the first visual state is an erased state.

5. The system as set forth in claim 1 wherein the first visual state is an imaged state.

6. The system as set forth in claim 1 wherein the second state is an erased state.

7. The system as set forth in claim 1 wherein the second state is an imaged state.

8. The system as set forth in claim 1 wherein the light source is an ultraviolet light source.

9. The system as set forth in claim 1 wherein the heating element is a long wavelength heat source.

10. The system as set forth in claim 1 wherein the light source is programmable.

11. The system as set forth in claim 1 wherein the heating element is programmable.

12. The method as set forth in claim 1 wherein the heating element is a fuser of a multifunction device.

13. A method for forming temporary images on a transient medium, the method comprising:

processing an image to be printed;

conveying a transient media sheet on a path;

erasing the transient media sheet using a heating element along the path; and, forming the image on the transient media sheet using a light source along the path.

14. The method as set forth in claim 13 wherein forming the image comprises using an ultraviolet light source.

15. A method for forming temporary images on a transient media, the method comprising:

processing an image to be printed;

conveying a transient media sheet on a path;

erasing the transient media sheet using a light source along the path; and, forming the image on the transient media sheet using a heating element along the path.

16. The method as set forth in claim 15 wherein the light source is an ultraviolet light source.

17. The method as set forth in claim 15 wherein the heating element is programmable.

* * * * *